US007570896B2

(12) United States Patent
Mikita et al.

(10) Patent No.: US 7,570,896 B2
(45) Date of Patent: Aug. 4, 2009

(54) FIXING APPARATUS AND IMAGE FORMING APPARATUS INCLUDING THE SAME

(75) Inventors: Toshiya Mikita, Yao (JP); Atsushi Ide, Nara (JP); Kohji Aoki, Nara (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 245 days.

(21) Appl. No.: 11/678,076

(22) Filed: Feb. 23, 2007

(65) Prior Publication Data

US 2007/0217804 A1 Sep. 20, 2007

(30) Foreign Application Priority Data

Mar. 16, 2006 (JP) ..... 2006-073378

(51) Int. Cl.
*G03G 15/20* (2006.01)

(52) U.S. Cl. ..... 399/69

(58) Field of Classification Search ..... 399/38, 399/67, 69, 70, 328, 329, 330, 331; 219/216
See application file for complete search history.

(56) References Cited

U.S. PATENT DOCUMENTS 5,742,865 A * 4/1998 Yajima et al. ..... 399/43
6,397,021 B2 * 5/2002 Hayashi et al. ..... 399/69
7,106,986 B2 * 9/2006 Nakayama ..... 399/69

FOREIGN PATENT DOCUMENTS

JP 10-186909 7/1998
JP 2002-357977 12/2002

* cited by examiner

*Primary Examiner*—Hoan H Tran
(74) *Attorney, Agent, or Firm*—Renner, Otto, Boisselle & Sklar, LLP

(57) ABSTRACT

In a fixing apparatus of the present invention, an end section fixing control temperature changing section selects an end section fixing control temperature in accordance with the number of paper sheets that have been processed in one continuous printing process. A sub-heater on/off determining section turns on or off a sub-heater in accordance with a temperature detected by an end section temperature sensor and the end section fixing control temperature selected by the end section fixing control temperature changing section. This prevents the occurrence of fixing failure even in continuous printing with respect to large-size paper sheets in an arrangement in which a temperature sensor is disposed outside a maximum-size sheet passing region at an end section of a fixing roller and controls energization of a heater which is disposed corresponding to the end section of the fixing roller in accordance with a temperature detected by the temperature sensor.

9 Claims, 10 Drawing Sheets

CROSS SECTION
OF END SECTION

CROSS SECTION
OF CENTER SECTION

| SETTING LEVELS | NUMBER OF PROCESSED SHEETS | PRESET FIXING TEMPERATURE OF END SECTION (°C) |
|---|---|---|
| LEVEL 1 | 1～10 | 185 |
| LEVEL 2 | 11～30 | 190 |
| LEVEL 3 | 31～50 | 195 |
| LEVEL 4 | 51～75 | 200 |
| LEVEL 5 | 76～ | 205 |

(JUST BEFORE PRINTING)

(RIGHT AFTER START OF PRINTING)

(IN MIDDLE OF PRINTING)

(AT END OF PRINTING)

FIXING APPARATUS AND IMAGE FORMING APPARATUS INCLUDING THE SAME

This Nonprovisional application claims priority under 35 U.S.C. § 119(a) on Patent Application No. 73378/2006 filed in Japan on Mar. 16, 2006, the entire contents of which are hereby incorporated by reference.

FIELD OF THE INVENTION

The present invention relates to (i) a fixing apparatus incorporated into an image forming apparatus using an electrophotographic process, for example, a copying machine, a facsimile, a printer, and a multifunction machine, and (ii) an image forming apparatus using the same.

BACKGROUND OF THE INVENTION

Conventionally, a heat roller fixing method has been generally used in a fixing apparatus incorporated into an image forming apparatus using an electrophotographic process. A copying machine and a printer are examples of such image forming apparatus. In the heat roller fixing method, a paper sheet (recording material) holding an unfixed toner image thereon passes between a heated fixing roller and a pressure roller which is press-contacted to the fixing roller so that the toner image is fused and fixed on the paper sheet.

A method that has been adopted in recent years is a method in which a plurality of heaters (heat sources, heating members) are disposed inside the fixing roller to partially heat the fixing roller. This method is adopted for the purposes of (i) reducing energy consumption of the image forming apparatus and (ii) improving life characteristics of the fixing roller in the fixing apparatus.

One example of an arrangement in which a plurality of heaters are disposed is an arrangement in which two heaters, a main heater and a sub-heater, are disposed. The main heater heats a center section of a fixing roller, and the sub-heater heats both end sections of the fixing roller. The main heater heats the center section of the fixing roller through which a small-sized paper sheet passes among paper sheets processable in an image forming apparatus. The sub-heater heats the end sections of the fixing roller through which a large-sized paper sheet passes.

In a surface temperature control of a fixing roller, the fixing roller is controlled so that a surface of the fixing roller keeps a preset fixing temperature. Generally, when a detected surface temperature of the fixing roller exceeds the preset fixing temperature, the heater is turned off (power to the heater is off). On the other hand, when the detected surface temperature become lower than the preset fixing temperature, the heater is turned on (power to the heater is on). In an arrangement in which a plurality of heaters are disposed, temperature sensors for detecting surface temperatures of the fixing roller are provided respectively in heating regions of the respective heaters of the fixing roller. On the basis of the temperatures detected by the temperature sensors, power to the heaters corresponding to the respective temperature sensors are on/off controlled.

Incidentally, in order to detect surface temperatures of the fixing roller with a high degree of accuracy, it is desirable to dispose the temperature sensors so as to be in contact with the surface of the fixing roller. However, an arrangement in which a plurality of temperature sensors are disposed so as to be in contact with the fixing roller causes the temperature sensors and the fixing roller to rub against each other. This may cause damage to the surface of the fixing roller, thus resulting in degradation in fixing quality. Especially, an arrangement in which the temperature sensors are disposed so as to press-contact the fixing roller tends to be a factor responsible for damage to the surface of the fixing roller. This is because pressure of the temperature sensors to the fixing roller is increased by thermal expansion that occurs in the fixing roller when the fixing roller reaches a preset fixing temperature.

In order to avoid such a problem, a temperature sensor which detects a temperature of the center section of the fixing roller (heating region of the main heater) where paper sheets from small-size paper sheets to large-size paper sheets pass (hereinafter referred to as center section temperature sensor) is generally disposed so as not to be in contact with the surface of the fixing roller. Meanwhile, a temperature sensor which detects a temperature of an end section of the fixing roller (heating region of the sub-heater) where small-size paper sheets do not pass (hereinafter referred to as end section temperature sensor) is disposed outside a maximum passing region so as to be in contact with the surface of the fixing roller. The maximum passing region is a region of the fixing roller where maximum-size paper sheets that can be used in the foregoing image forming apparatus pass.

For example, Japanese Unexamined Patent Publication No. 186909/1998 (Tokukaihei 10-186909) (published on Jul. 14, 1998) discloses an arrangement to avoid fixing failure in continuous printing. This arrangement is such that a heater is turned on during a time when a space between a recording material and a subsequent recording material passes in such a manner that a preset fixing temperature is increased as a temperature detected by a thermistor before energization of the heater is low, or such that the heater is turned on and a set temperature is increased as the amount of temperature rise is small (a speed of temperature rise is slow).

However, when temperatures of the fixing roller are controlled by using the center section temperature sensor and the end section temperature sensor disposed in the above manner, fixing failure can occur in continuous printing depending upon a paper size used.

This problem is caused by control of energization of the sub-heater on the basis of a result of detection carried out by the end section temperature sensor. In other words, the end section temperature sensor is disposed outside the maximum-size sheet passing region, and does not directly detect a temperature of the region where a paper sheet actually has passed. Because of this, a surface temperature of the sheet passing region is estimated on the basis of a temperature detected by the end section temperature sensor so that energization of the sub-heater is controlled. Practically, a relationship between a temperature detected by the end section temperature sensor and a temperature of the sheet passing region at the end section of the fixing roller is determined empirically, and a control temperature is managed on the basis of a temperature detected by the end section temperature sensor so that the temperature of the sheet passing region becomes a preset fixing temperature.

However, it is difficult to perform control so that a temperature of the sheet passing region becomes a preset fixing temperature by the temperature sensor which is disposed outside the maximum-size sheet passing region.

FIG. 9 illustrates progressions of surface temperatures of the fixing roller in (i) a region of the fixing roller where a paper sheet passes (hereinafter referred to as "passing region") and (ii) a region of the fixing roller where a paper sheet does not pass (hereinafter referred to as "non-passing region"), in continuous printing process. FIG. 9 shows a case where one heater is provided inside the fixing roller.

In a standby mode, the surface of the fixing roller is maintained at a preset fixing temperature under on/off control of the heater. When printing process is started in this state, a surface temperature of the passing region begins to decrease because heat is taken away from the passing region by the paper sheet, and then decreases to a temperature close to a lower-limit fixing temperature. Since the heater is turned on when the surface temperature of the passing region become lower than the preset fixing temperature, there is loss of time of thermal propagation inside the fixing roller. However, the surface temperature of the passing region begins to rise and returned to the preset fixing temperature. Thereafter, the surface of the passing region is maintained at the preset fixing temperature. When the printing completes, the surface of the passing region is maintained at the preset fixing temperature under control of temperature of the fixing roller in the standby mode.

On the other hand, a surface temperature of the non-passing region slightly decreases after the printing process is started, because the fixing roller is rotated. However, heat is not taken away from the non-passing region by the paper sheet. Then, the surface temperature of the non-passing region rises quickly because the heater is turned on. Thereafter, the surface temperature of the non-passing region rises gradually, and the surface of the non-passing region is maintained at a temperature close to an upper-limit fixing temperature that is an upper limit. Thereafter, the surface temperature of the non-passing region begins to decrease because the heater is turned off at the end of printing, and the surface of the non-passing region is maintained at the preset fixing temperature under temperature control in the standby mode.

As is clear from FIG. 9, difference in temperature between the passing region and the non-passing region varies between at the beginning of the continuous printing process and at the end of the continuous printing process. Thus, when the sub-heater is on/off controlled in accordance with a temperature detected by the end section temperature sensor which is disposed outside the maximum-size sheet passing region, the event can occur where the sub-heater is not turned on in a situation where the sub-heater must be turned on in carrying out printing using large-size paper sheets.

This is explained with reference to FIGS. 10(*a*) through 10(*d*). FIGS. 10(*a*) through 10(*d*) illustrate relationships between positions of the fixing roller in its axial direction and surface temperatures of the fixing roller, just before the start of continuous printing, right after the start of the continuous printing using large-size paper sheets, in the middle of the continuous printing, and at the end of the continuous printing, respectively.

As illustrated in FIG. 10(*a*), a surface temperature of the fixing roller just before the start of continuous printing is constant in the entire region of the fixing roller in its axial direction. In such a state, when the continuous printing is started and large-size paper sheets pass, a temperature of the sheet passing region becomes lower than the preset fixing temperature. This causes a temperature detected by the center section temperature sensor to become lower than a control temperature, and the main heater is therefore turned on. Meanwhile, a temperature detected by the end section temperature sensor decreases because heat is taken away from the end section of the fixing roller by the sheet passing region whose temperature has decreased. Thus, the sub-heater is also turned on.

Right after the start of the continuous printing, as illustrated in FIG. 10(*b*), a surface temperature of the sheet passing region is constant in the entire region of the fixing roller in its axial direction because both the main heater and the sub-heater are turned on. Note that a surface temperature of the sheet passing region is slightly lower than the preset fixing temperature due to loss of thermal expansion inside the fixing roller and other reasons. A region where paper sheets do not pass in the end section of the fixing roller (hereinafter referred to as non-sheet-passing region) is heated under heat of the sub-heater which is turned on. Accordingly, a surface temperature of the non-sheet-passing region exceeds the preset fixing temperature. Since the end section temperature sensor is disposed in the non-sheet-passing region, difference in temperature from the sheet passing region increases. A surface temperature of the non-sheet-passing region becomes increasingly higher when the sub-heater keeps being turned on. As a result, the above-mentioned difference in temperature increases as printing is continued.

When difference in surface temperature between the sheet-passing region and the non-sheet-passing region increase, a temperature detected by the end section temperature sensor does not become lower than the control temperature. This results in the following event: Although a temperature of the sheet passing region does not actually reach the preset fixing temperature as illustrated in FIG. 10(*c*), the sub-heater is not turned on, and only the main heater is turned on. In addition, a temperature of the non-sheet-passing region keeps rising under heat of only the main heater which is turned on.

This event occurs due to unnecessary heat supply by the main heater. That is, in the case of heaters whose heat generating regions that give off heat are different from each other, including the main heater and the sub-heater, positions that are in no need of heating in a fixing roller are unnecessarily heated. FIG. 11 illustrates a relationship between a position of the fixing roller in its axial direction and a heat supply rate in the main heater and the sub-heater.

When the main heater keeps being turned on, such an unnecessary heat supply by the main heater causes unnecessary heat supply to the end section of the fixing roller. As a result, a surface temperature of the region where the end section temperature sensor is disposed further rises gradually because a method for dissipating heat of the region where the end section temperature sensor is disposed is just heat release in the air or thermal movement into the fixing roller by heat conduction.

As a result, at the end of the continuous printing, although the center section of the fixing roller is maintained at the preset fixing temperature, temperatures of the end sections of the fixing roller become lower than the preset fixing temperature, as illustrated in FIG. 10(*d*).

Due to such variations in temperature on the surface of the fixing roller, a paper sheet suffers from fixing failure such that the paper sheet has a lower gloss at a part that have passed through the center section of the fixing roller where a temperature is high than at parts that have passed through the end sections of the fixing roller where a temperature is low.

It is to be noted that the invention described in the aforesaid Japanese Unexamined Patent Publication cannot solve the above problem because it does not assume a fixing apparatus that has a plurality of heaters disposed inside a fixing roller to partially heat the fixing roller, and it does not estimate a temperature of the sheet passing region by using a temperature sensor which is disposed outside the maximum-size sheet passing region.

SUMMARY OF THE INVENTION

An object of the present invention is to provide (i) a fixing apparatus which includes a plurality of heaters that are provided inside a fixing roller and are able to partially heat the fixing roller and which prevents the occurrence of fixing failure even in continuous printing with respect to large-size paper sheets in an arrangement in which a temperature sensor is disposed outside a maximum-size sheet passing region at an end section of the fixing roller and controls energization of a heater which is disposed corresponding to the end section of the fixing roller in accordance with a temperature detected by the temperature sensor; and (ii) an image forming apparatus.

In order to attain the above object, a fixing apparatus of the present invention is a fixing apparatus which causes a recording material to pass between a rotatable fixing member and a pressure member that press-contacts the fixing member so as to fix a toner image formed on the recording material, the fixing apparatus comprising: a plurality of heat sources, which are disposed inside the fixing member, having mutually different regions as heating regions; a plurality of temperature detecting members, disposed on a surface side of the fixing member so as to correspond to the heat sources, which detect surface temperatures of the fixing member; and a fixing control section which controls power supplies to the heat sources so that surfaces of the fixing member are maintained at a preset fixing temperature, in accordance with temperatures detected by the temperature detecting members, wherein: out of the temperature detecting members, an end section temperature detecting member which is disposed at an end section of the fixing member is disposed outside a region of the fixing member where a maximum-size recording material that can be used by an image forming apparatus in which the fixing apparatus is installed passes; and in continuous printing process, the fixing control section changes a control temperature for controlling power supply to the heat source which is disposed corresponding to the end section of the fixing member, in accordance with a temperature detected by the end section temperature detecting member.

In order to attain the above object, an image forming apparatus of the present invention is an image forming apparatus comprising a fixing apparatus which causes a recording material to pass between a rotatable fixing member and a pressure member that press-contacts the fixing member so as to fix a toner image formed on the recording material, the fixing apparatus comprising: a plurality of heat sources, which are disposed inside the fixing member, having mutually different regions as heating regions; a plurality of temperature detecting members, disposed on a surface side of the fixing member so as to correspond to the heat sources, which detect surface temperatures of the fixing member; and a fixing control section which controls power supplies to the heat sources so that surfaces of the fixing member are maintained at a preset fixing temperature, in accordance with temperatures detected by the temperature detecting members, wherein: out of the temperature detecting members, an end section temperature detecting member which is disposed at an end section of the fixing member is disposed outside a region of the fixing member where a maximum-size recording material that can be used by the image forming apparatus passes; and in continuous printing process, the fixing control section changes a control temperature for controlling power supply to the heat source which is disposed corresponding to the end section of the fixing member, in accordance with a temperature detected by the end section temperature detecting member.

In continuous printing with respect to paper sheets having a size that requires power supply to the heat source disposed corresponding to the end section of the fixing member (hereinafter referred to as end section heat source), failure of power supply to the end section heat source can occur because a surface temperature of the fixing member decreases in a recording material passing region at the end section of the fixing member, but a temperature detected by the end section temperature detecting member which is disposed in a region of the fixing member where the recording material does not pass.

However, according to the above arrangement, in continuous printing process, the fixing control section changes a control temperature for controlling power supply to the end section heat source which is disposed corresponding to the end section of the fixing member, in accordance with a temperature detected by the end section temperature detecting member which is disposed outside a region of the fixing member where a maximum-size recording material that can be used by the image forming apparatus passes. More specifically, the larger the number of paper sheets that have been processed in one continuous printing process, the higher the fixing control section sets the control temperature.

Thus, even when there is rise in temperature detected by the end section temperature detecting member, which is disposed in a region of the fixing member where the recording material does not pass, the control temperature itself is changed. This avoids the failure of power supply to the end section heat source.

This makes it possible to avoid the occurrence of fixing failure in continuous printing process with respect to a large-size recording material, in the fixing apparatus which includes a plurality of heaters that are provided inside a fixing roller and are able to partially heat the fixing roller and which disposes a temperature sensor outside a maximum-size sheet passing region at an end section of the fixing member and controls a heat source which is disposed corresponding to the end section of the fixing roller in accordance with a temperature detected by the temperature sensor.

Additional objects, features, and strengths of the present invention will be made clear by the description below. Further, the advantages of the present invention will be evident from the following explanation in reference to the drawings.

DESCRIPTION OF THE EMBODIMENTS

An image forming apparatus according to an embodiment of the present invention is explained below with reference to FIGS. 1 through 8.

Figure 2:
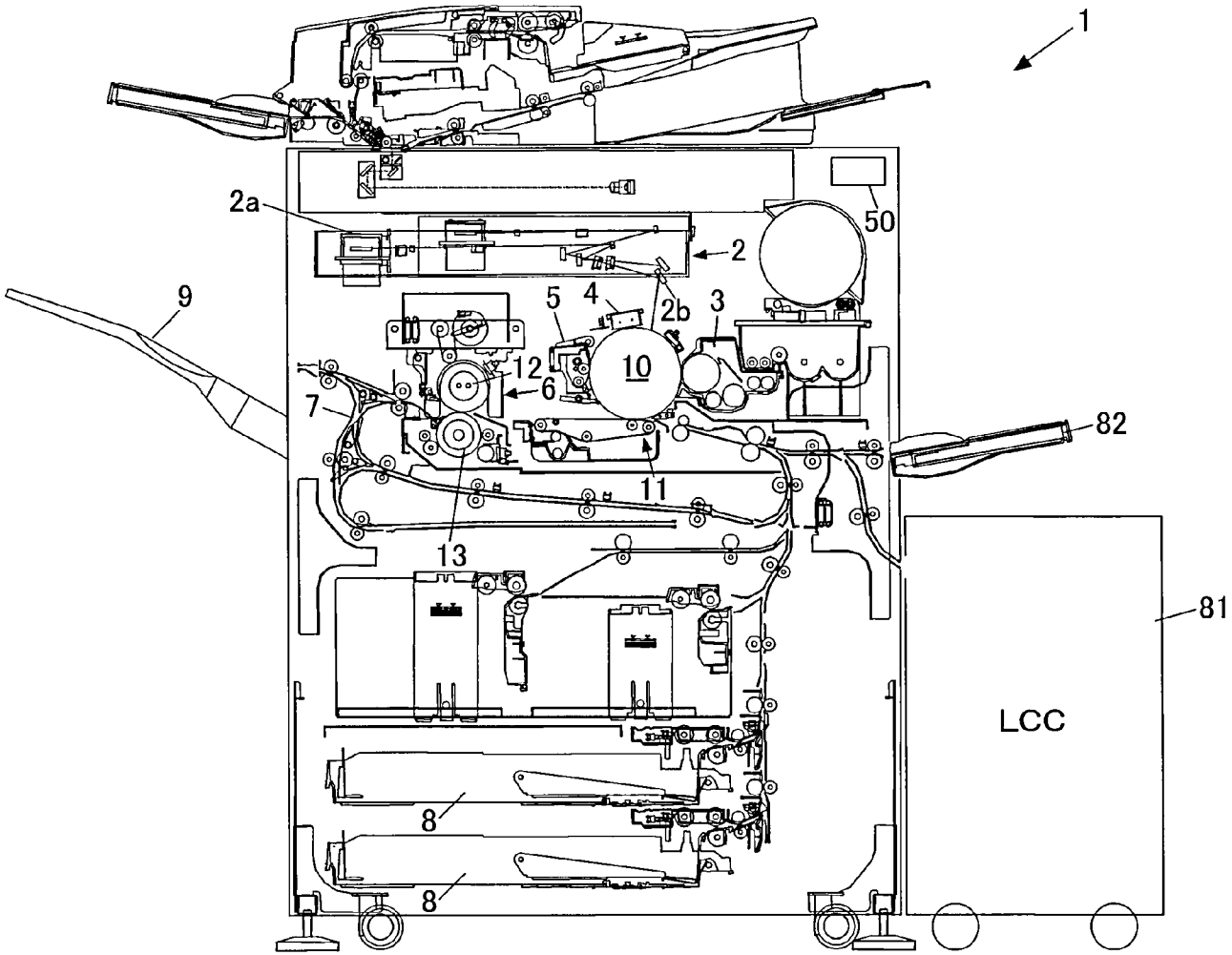
FIG. 2 is a longitudinal sectional view illustrating an embodiment of the present invention and a structure of an image forming apparatus including the fixing unit.

FIG. 2 is a longitudinal sectional view of an image forming apparatus 1 of the present embodiment. The image forming apparatus 1 of the present embodiment forms a single color image with respect to a predetermined sheet (recording sheet) in accordance with image data transmitted externally and/or image data read by the image forming apparatus 1 itself. The image forming apparatus 1, as illustrated in FIG. 2, includes an exposure unit 2, a developing unit 3, a photoreceptor drum 10, a transfer unit 11, an electrostatic charging unit 4, a cleaning device 5, a fixing unit (fixing apparatus) 6, a paper feed tray 8, a output paper tray 9, and a control section 50.

The electrostatic charging unit 4 is a section for electrostatically charging a surface of the photoreceptor drum 10 to a predetermined potential evenly. The electrostatic charging unit 4 may be a noncontact discharger as illustrated in FIG. 2. Alternatively, the electrostatic charging unit 4 may be a contact electrostatic charger of roller type or brush type.

The exposure unit 2 subjects the photoreceptor drum 10 that has been evenly charged by the electrostatic charging unit 4 to exposure according to the image data, so as to form a latent image corresponding to the image data on the surface of the photosensitive drum 10.

Figure 1:
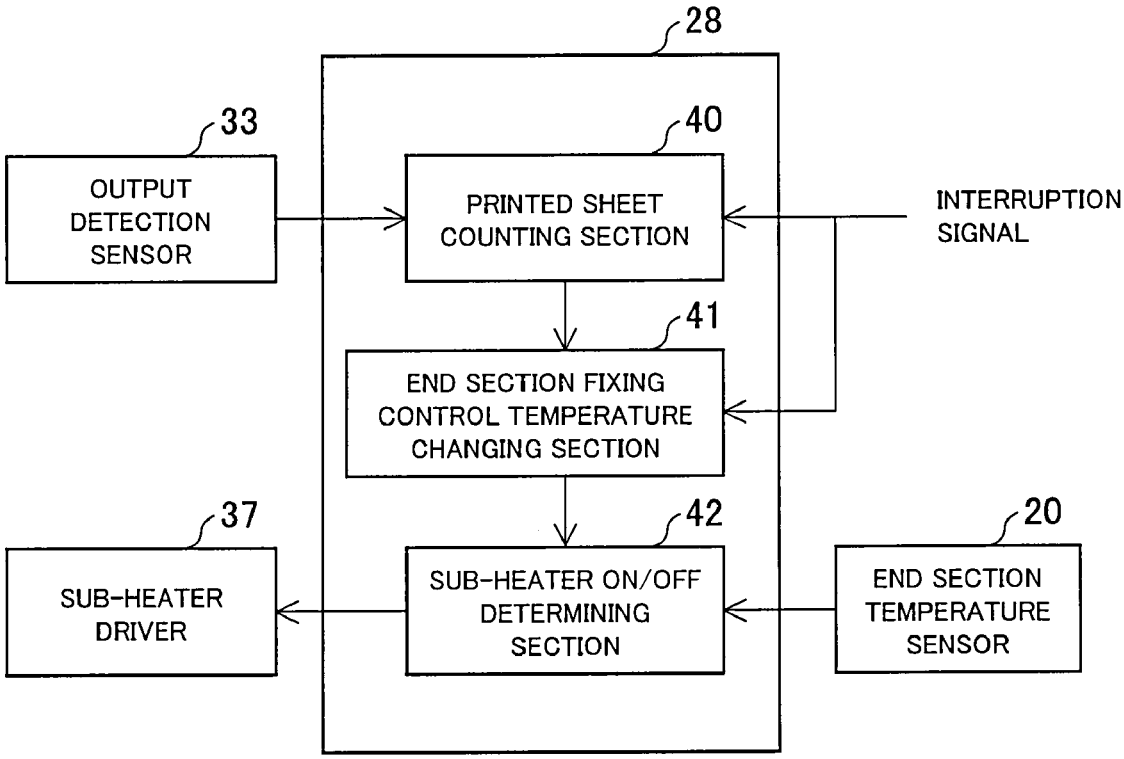
FIG. 1 is a block diagram illustrating an embodiment of the present invention and a configuration of an end section temperature control section of a fixing unit.

The exposure unit 2 may be a laser scanning unit (LSU) including a laser irradiation section 2*a* and a reflecting mirror 2*b*, as illustrated in FIG. 1. The exposure unit 2 may also be a writing head in which light emitting elements (for example, EL and LED) are arranged in an array. The image forming apparatus 1 of the present embodiment realizes a high-speed printing by adopting a two beam technique which alleviates speeding up of irradiation timing by using a plurality of laser beams.

The developing unit 3 forms a toner image by developing with a black toner the latent image formed on the surface of the photosensitive drum 10.

The transfer unit 11 transfers the toner image formed on the photosensitive drum 10 by the developing unit 3 onto a paper sheet transported.

The fixing unit 6 fuses and fixes the toner image on the paper sheet on which the unfixed toner image has been transferred by the transfer unit 11, when the paper sheet passes through a space between a rotatable fixing roller (fixing member) 12 and a pressure roller (pressure member) 13 (hereinafter, referred to as a "fixing nip area"). The pressure roller 13 press-contacts the fixing roller 12. The fixing unit 6 is explained in details later.

The cleaning unit 5 removes and collects a residual toner left on the photosensitive drum 10 after the image is developed and transferred.

The paper feed tray 8 is a tray that stores paper sheets to be used for image formation. In the present embodiment, a plurality of paper feed trays 8 are provided at a bottom part of the image forming apparatus 1 in order to carry out high-speed printing processing with respect to a large amount of paper sheets. In each of the paper feed trays, 500 to 1500 regular sized sheets of paper are stored. Moreover, in addition to the paper feed trays 8, a large capacity paper feed cassette (LCC) 81 and a manual paper feed tray 82 are provided on the side surface of the image forming apparatus 1. The LCC 81 is capable of storing a large amount of paper sheets of different kinds. The manual paper feed tray 82 is used mainly when printing is carried out with respect to irregular sized paper sheets.

The output paper tray 9 holds a paper sheet on which image formation has been completed. The output paper tray 9 is provided on a side surface of the image forming apparatus 1 opposite to the side surface thereof having the manual paper feed tray 82. Moreover, in the image forming apparatus 1 of the present embodiment, the output paper tray 9 can be optionally replaced by (i) a post processing device for carrying out, for example, stapling and/or hole-punching with respect to a paper sheet which has been subjected to image formation, and/or (ii) a plurality of output paper trays.

The control section 50 controls operations of the above mentioned members and carries out image processing based on image data. The control section 50 is a microcomputer including a CPU (Central Processing Unit) and a RAM (Random Access Memory) at least. The control section 50 operates by loading a program recorded in a storage medium (not shown). Detailed explanation is given later on the control section 50. The control section 50 constitutes a fixing control section 30 explained later.

Figure 3:
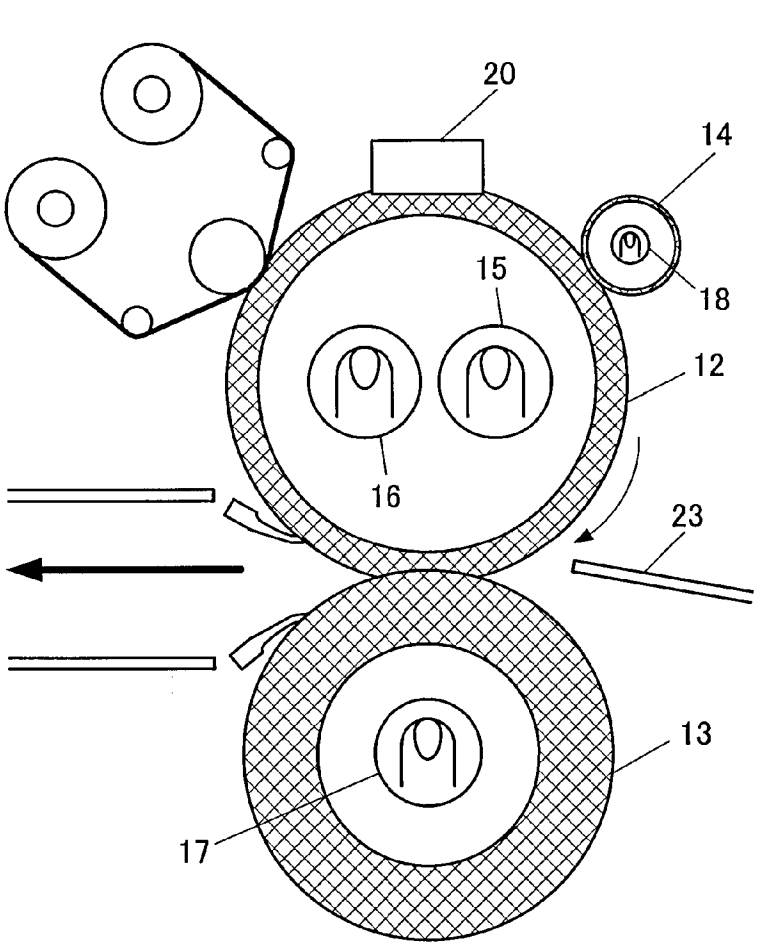
FIG. 3(*a*) is a sectional view illustrating a center section of the fixing unit, and FIG. 3(*b*) is a sectional view illustrating an end section of the fixing unit.
Figure 3:
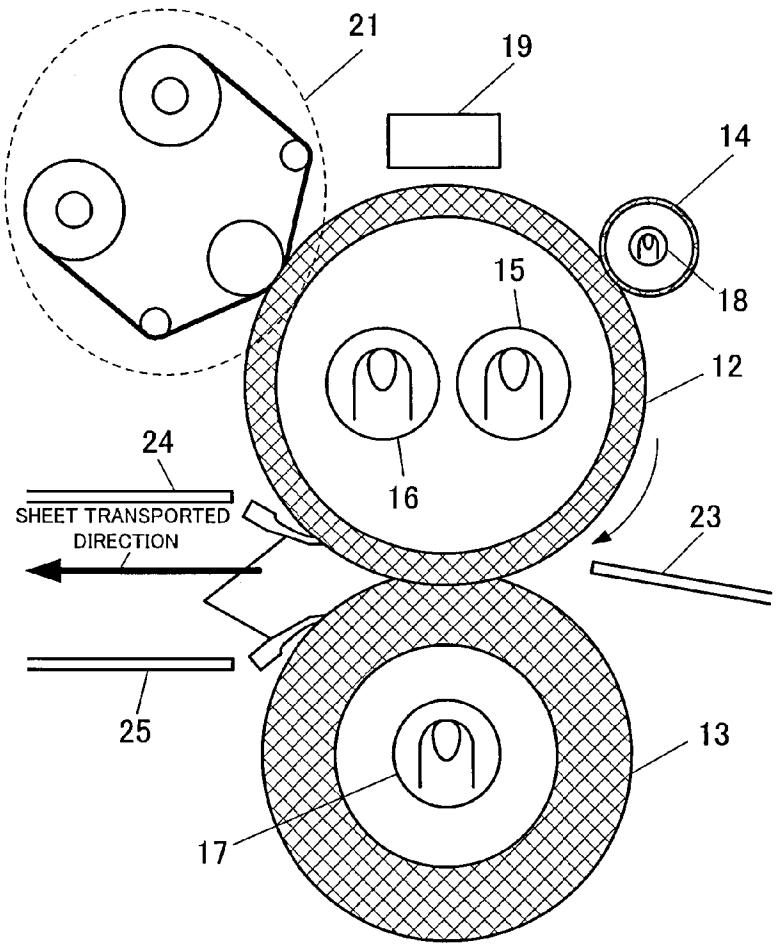
Figure 4:
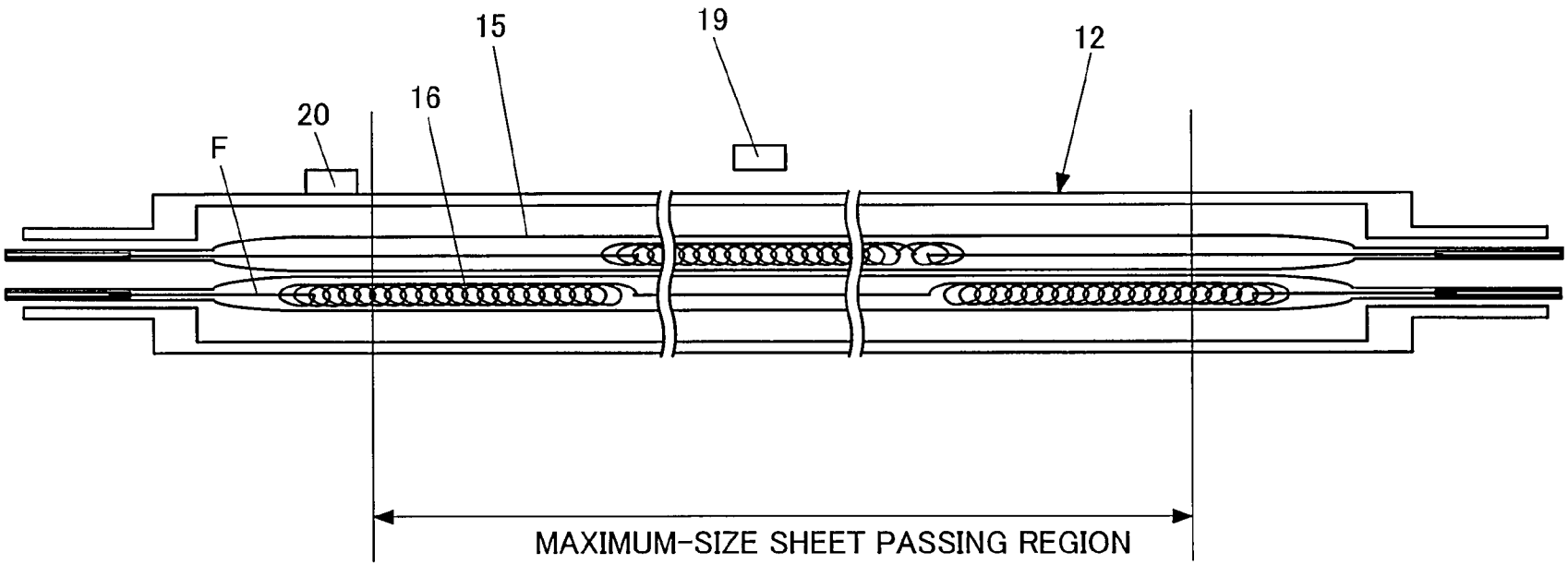
FIG. 4 is a view illustrating positional relationship between heat generating regions that give off heat in heat sources which are disposed inside the fixing roller which is provided in the fixing unit.

Next, the fixing unit 6 is explained in details. FIGS. 3(*a*) and 3(*b*) illustrate schematic cross sectional views of the fixing unit 6. FIG. 3(*a*) is a cross sectional view illustrating center sections of the fixing roller 12 and the pressure roller 13. FIG. 3(*b*) is a cross sectional view illustrating end sections of the fixing roller 12 and the pressure roller 13. FIG. 4 illustrates positional relationship between heat generating regions that give off heat in heat sources which are provided inside the fixing roller 12.

The fixing roller 12 is heated to a predetermined temperature and heats a paper sheet passing through the fixing nip area and having a toner image (unfixed) formed thereon. The fixing roller 12 is constituted by (i) a tube made of metal such as iron, stainless steel, aluminum, and copper, or metal alloy of combinations of any of these substances; and (ii) a silicone rubber (2 to 3 mm), as an elastic layer, wrapped around the tube. The layer made of silicone rubber has a function to provide a thermal storage effect. Moreover, a release layer (not shown) may be provided on the elastic layer. The release layer is made of fluorocarbon resin such as PFA (tetrafluoroetylene-perfluoroalkylvinylether copolymer) and PTFE (polytetrafluoroetylene).

The fixing roller 12 includes a heating section inside the tube. The heating section raises a temperature of the surface of the fixing roller 12 to a temperature required to fix a toner image. The surface of the fixing roller 12 is heated by the heating section so as to have a preset fixing temperature (here, 180° C., but generally 160° C. to 200° C.). The heating section here includes two heat sources, a main heater (center section heat source, main heat source) 15 and a sub-heater (end section heat source, sub-heat source) 16. The heating section is arranged so as to be capable of heating the surface of the fixing roller 12 in such a manner that the center section and the end sections are heated separately.

As illustrated in FIG. 4, the main heater 15 has a heat generating region where a filament F is wound, at a position corresponding to the center section of the fixing roller 12. The heat generating region is arranged to heat the center section of the fixing roller 12. Meanwhile, the sub-heater 16 has heat generating regions where a filament F is wound at positions corresponding to opposite sides of the heat generating region of the main heater 15. The heat generating regions of the sub heater 16 are arranged to heat the end sections of the fixing roller 12.

In the center section and the end sections of the fixing roller 12 disposed are temperature sensors 19 and 20 for detecting surface temperatures of the fixing roller 12. The temperature sensors 19 and 20 are thermistors, for example. These temperature sensors 19 and 20 constitute a temperature detection section in which the surface temperatures of areas on the fixing roller 12 corresponding to the heating regions of the main heater 15 and the sub-heater 16, which are a heating section capable of heating the surface of the fixing roller 12 partially.

The temperature sensor 19 is a center section temperature sensor which is disposed so as not to be in contact with the surface of the fixing roller 12 (hereinafter referred to as center section temperature sensor 19). The center section temperature sensor 19 detects a temperature of the center section of the fixing roller 12. The temperature sensor 20 is an end section temperature sensor which is disposed so as to be in contact with the surface of the fixing roller 12 (hereinafter referred to as end section temperature sensor 20). The end section temperature sensor 20 detects a temperature of the end section of the fixing roller 12 (heating region of the sub-heater) where a small-sized paper sheet does not pass. The end section temperature sensor 20 is disposed outside the region of the fixing roller 12 through which a maximum-size paper sheet that can be used in the image forming apparatus 1 passes.

On the other hand, the pressure roller 13 includes a press-contacting mechanism (not shown) at end sections thereof. The press-contacting mechanism allows the pressure roller 13 to press-contact the fixing roller 12 at a predetermined pressure. The pressure roller 13 is constituted by (i) a tube made of metal such as iron, stainless steel, aluminum, and copper, or metal alloy of combinations of any of these substances; and (ii) a silicone rubber (5 to 10 mm), as an elastic layer, wrapped around the tube. The layer made of silicone rubber has a function to provide a thermal storage effect, as with the layer on the fixing roller 12.

In the present embodiment, the pressure roller 13 is also provided therein with a heater (hereinafter, referred to as a pressure side heater) 17 that serves both as a heating section and a heat source. This arrangement suppresses an amount of heat that the pressure roller 13 takes away from the fixing roller 12. A heat generating region of the pressure side heater 17 covers an entire area of the pressure roller 13.

On respective peripheries of the fixing roller 12 and the pressure roller 13 disposed are paper separation claws 22. The paper separation claws 22 separate a paper sheet wrapped around the fixing roller 12 or the pressure roller 13. Moreover, a cleaning unit 21 is provided on the periphery of the fixing roller 12. The cleaning unit 21 removes toner adhering to the surface of the fixing roller 12.

After a paper sheet guided along a paper guide 23 from the transfer unit 11 (Refer to FIG. 2) passes through the fixing nip area, the paper sheet is separated from the fixing roller 12 or the pressure roller 13 by the paper separation claws 22. Then, the paper sheet is carried along paper guides 24 and 25. After the paper sheet is separated, the surface of the fixing roller 12 is cleaned by the cleaning unit 21.

Moreover, the image forming apparatus 1 of the present embodiment is further provided with an external heating roller 14 in order to carry out high-speed printing processing. The external heating roller 14 heats the fixing roller 12 from the surface of the fixing roller 12. The external heating roller 14 has an arrangement in which a heater (hereinafter, referred to as an external heating heater) 18 is provided inside a very thin tube made of aluminum, iron, or the like. The external heating heater 18 is a heating section and also a heat source. The tube of the external heating roller 14 has a thickness of 0.2 to 0.5 mm, which depends on which material is selected for the external heating roller 14. With this arrangement, a temperature of the external heating roller 14 quickly rises under heat from the external heating heater 18 so that the external heating roller 14 heats the surface of the fixing roller 12. As illustrated in FIG. 4, the external heating heater 18 provided inside the external heating roller 14 has a heat generating region that covers an entire area of the external heating roller 14.

In the fixing unit 6, among the fixing roller 12, the pressure roller 13, and the external heating roller 14, only the fixing roller 12 is connected to a driving source and driven so as to rotate. The surfaces of the pressure roller 13 and the external heating roller 14 are in contact with the surface of the fixing roller 12, which allows the pressure roller 13 and the external heating roller 14 to rotate dependently with respect to the rotation of the fixing roller 12.

Figures 5, 6:
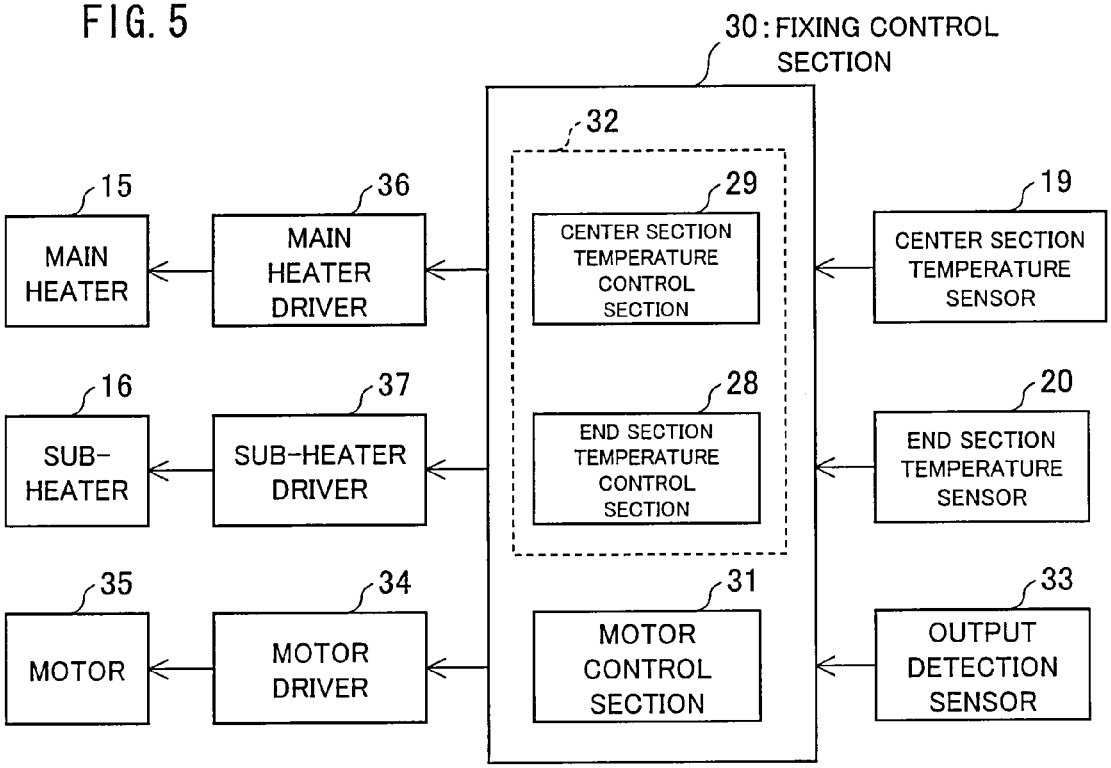
FIG. 5 is a block diagram illustrating a configuration of a control system of the fixing unit.
FIG. 6 is a view illustrating contents of a table which is included in an end section fixing control temperature changing section of the end section temperature control section.

FIG. 5 is a block diagram illustrating a control system of the fixing unit 6. In FIG. 5, a reference number 30 represents a fixing control section. The fixing control section 30 controls rotation of the fixing roller 12 and power supply to the heaters 15 through 18, in accordance with a temperatures detected by the center section temperature sensor 19 and the end section temperature sensor 20, which constitute the temperature detection section. In this way, the fixing control section 30 controls the surface temperature of the fixing roller 12 so that the surface of the fixing roller 12 is maintained at a preset fixing temperature.

The fixing control section 30 includes a motor control section 31 and a temperature control section 32. The motor control section 31 controls a motor 35 via a motor driver 34 in accordance with temperature data sent from the temperature control section 32 and output of an output detection sensor 33. The motor 35 is a driving source for rotating the fixing roller. The output detection sensor 33 detects output of a paper sheet to the outside of a main body of the image forming apparatus 1.

The temperature control section 32 has a center section temperature control section 29 and an end section temperature control section 28. Note that although it is possibly considered that the temperature control section 32 further has control sections that controls temperatures of the pressure roller 13 and the external heating roller 14, explanations of temperature controls of the external heating roller 14 and the pressure roller 13 are omitted here for the sake of convenience.

The center section temperature control section 29 causes the main heater driver 36 to control output (heat amount) of the main heater 15 in accordance with a temperature detected by the center section temperature sensor 19 so that the surface of the center section of the fixing roller 12 is maintained at the preset fixing temperature.

The end section temperature control section 28 causes the sub-heater driver 37 to control outputs (heat amounts) of the sub-heater 16 in accordance with a temperature detected by the end section temperature sensor 20 so that the surface of the end section of the fixing roller 12 is maintained at the preset fixing temperature.

The center section temperature control section 29 and the end section temperature control section 28 cause the main heater driver 36 and the sub-heater driver 37 to control outputs (heat amounts) of the main heater 15 and the sub-heater 16, respectively, so as to control power supplies to the main heater 15 and the sub-heater 16. Here, power supplies (energization) to the main heater 15 and the sub-heater 16 are turned on or off.

The center section temperature control section 29 has a center section fixing control temperature that determines whether the main heater 15 is to be turned on or off so that a surface temperature of the center section of the fixing roller 12 becomes the above-mentioned preset fixing temperature. When a temperature detected by the center section temperature sensor 19 is lower than the center section fixing control temperature, the center section temperature control section 29 turns on the main heater 15, determining that a surface temperature of the center section of the fixing roller 12 has become lower than the preset fixing temperature. On the other hand, when a temperature detected by the center section temperature sensor 19 exceeds the center section fixing control temperature, the center section temperature control section 29 turns off the main heater 15, determining that a surface temperature of the center section of the fixing roller 12 has exceeded the preset fixing temperature.

As described previously, the end section temperature control section 28 actually determines empirically a relationship between a temperature detected by the end section temperature sensor 20, which is provided outside the maximum-size sheet passing region of the fixing roller 12, and an actual temperature of the sheet passing region of the fixing roller 12, so as to manage energization of the sub-heater 16 on the basis of the temperature detected by the end section temperature sensor 20.

The end section temperature control section 28 has an end section fixing control temperature that determines whether the sub-heater 16 is to be turned on or off so that a surface temperature of the sheet passing section which is on the side of the end section of the fixing roller 12 becomes the above-mentioned preset fixing temperature. When a temperature detected by the end section temperature sensor 20 becomes lower than the end section fixing control temperature, the end section temperature control section 28 turns on the sub-heater 16, determining that a surface temperature of the sheet passing region which is on the side of the end section of the fixing roller 12 has become lower than the preset fixing temperature. On the other hand, a temperature detected by the end section temperature sensor 20 exceeds the end section fixing control temperature, the end section temperature control section 28 turns off the sub-heater 16, determining that a surface temperature of the sheet passing region which is on the side of the end section of the fixing roller 12 has exceeded the preset fixing temperature. Since the end section temperature sensor 20 detects a temperature of a region where a sheet does not pass on the fixing roller 12, the end section fixing control temperature is higher than the preset fixing temperature.

It is to be noted that the end section temperature control section 28 is arranged so as to change the end section fixing control temperature for controlling power-on/off of the sub-heater 16 in the continuous printing process. The larger the number of paper sheets that have been processed in one continuous printing process or the number of paper sheets that have continuously passed through the fixing nip area, the higher the end section temperature control section 28 sets the end section fixing control temperature.

FIG. 1 more specifically illustrates the configuration of the end section temperature control section 28. The end section temperature control section 28 has a printed sheet counting section (counting section) 40, an end section fixing control temperature changing section 41, a sub-heater on/off determining section 42. The printed sheet counting section 40 is constituted by a counter that counts the number of paper sheets that have been processed in one continuous print job, and other components.

The end section fixing control temperature changing section 41 includes a table that has control temperatures determined corresponding to the number of processed paper sheets, and selects a suitable end section fixing control temperature in accordance with a result of counting carried out by the printed sheet counting section 40. The selected end section fixing control temperature is transmitted to the sub-heater on/off determining section 42. The printed sheet counting section 40 can optionally be replaced by a component that counts the number of paper sheets that have continuously passed through the fixing nip area in one continuous print job.

FIG. 6 illustrates one example of a table including control temperatures corresponding to the number of processed paper sheets. In FIG. 6, the end section fixing control temperature changing section 41 can change a setting level in five levels, Levels 1 through 5. When the number of printed paper sheets is 1 to 10, Level 1, i.e. 185° C. that is an initial value is selected as the end section fixing control temperature. When the number of printed paper sheets is 11 to 30, Level 2, i.e. 190° C. is selected as the end section fixing control temperature. When the number of printed paper sheets is 31 to 50, Level 3, i.e. 195° C. is selected as the end section fixing control temperature. When the number of printed paper sheets is 51 to 75, Level 4, i.e. 200° C. is selected as the end section fixing control temperature. When the number of printed paper sheets is 76 or more, Level 5, i.e. 205° C. is selected as the end section fixing control temperature.

The sub-heater on/off determining section 42 determines whether the sub-heater 16 is to be turned on or off in accordance with a temperature detected by the end section temperature sensor 20 and the control temperature selected by the end section fixing control temperature changing section 41. A result of the determination is outputted to a sub-heater driver 38.

Figure 7:
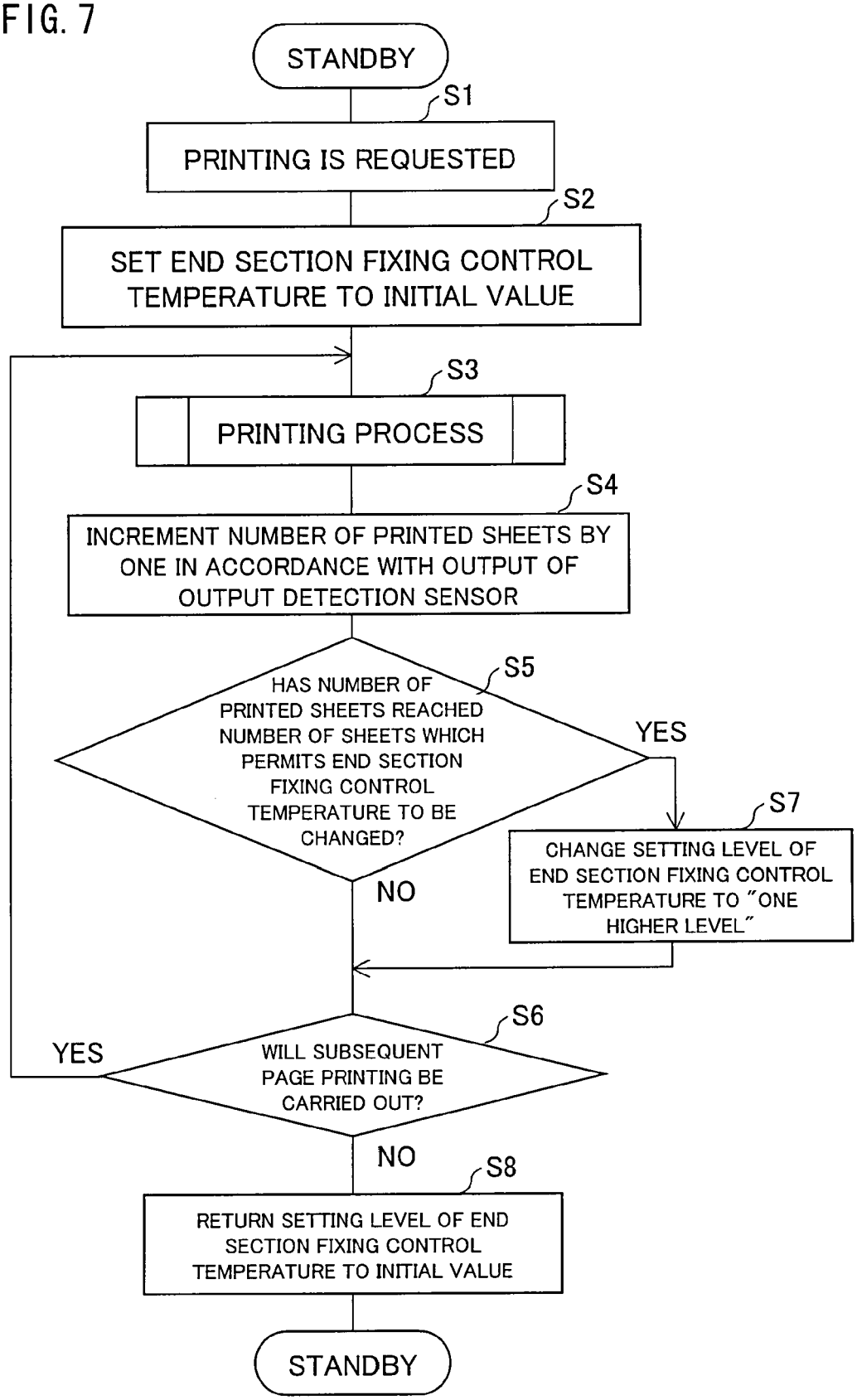
FIG. 7 is a flowchart illustrating one example of surface temperature control in the end section temperature control section in a continuous printing process.

FIG. 7 illustrates one example of a flow of control of surface temperature of the fixing roller 12 in the end section temperature control section 28 in the continuous printing process.

During a standby state, if a print job of the continuous printing process is requested (S1), the end section fixing control temperature is set to the initial value of Level 1 (S2). Then, printing is carried out (S3). Every time one paper sheet is subjected to printing, the printed sheet counting section 40 increments by one in accordance with detection of the output detection sensor 33 (S4), and it is judged whether the number of processed paper sheets counted by the printed sheet counting section 40 has reached the number of paper sheets which permits the end section fixing control temperature to be changed (S5).

In S5, when it is judged that the number of processed paper sheets counted by the printed sheet counting section 40 has reached the number of paper sheets that permits the end section fixing control temperature to be changed, a setting level of the end section fixing control temperature is changed to one higher level (S7). Thereafter, it is judged whether or not a subsequent page printing will be carried out (S6). On the other hand, in S5, when it is judged that the number of processed paper sheets counted by the printed sheet counting section 40 has not reached the number of paper sheets that permits the end section fixing control temperature to be changed, the procedure proceeds to S6 to judge whether or not a subsequent page printing will be carried out.

In S6, if it is judged that a subsequent page printing will be carried out, the procedure returns to S3 to carry out printing of a subsequent page. On the other hand, in S6, if it is judged that a subsequent page printing will not be carried out, a setting level of the end section fixing control temperature is returned to the initial value of Level 1 (S8), so that the procedure goes into the standby mode.

Figure 8:
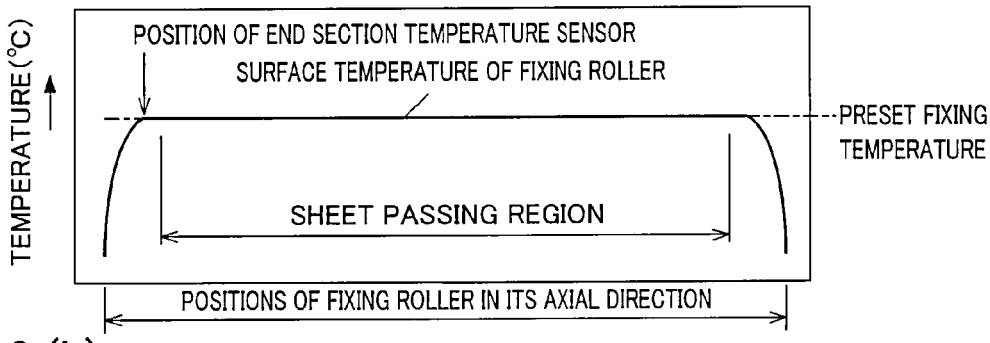
FIGS. 8(*a*) through 8(*d*) are views illustrating relationships between positions of the fixing roller in its axial direction and surface temperatures of the fixing roller in the present image forming apparatus, just before the start of continuous printing, right after the start of the continuous printing using large-size paper sheets, in the middle of the continuous printing, and at the end of the continuous printing, respectively.
Figure 8:
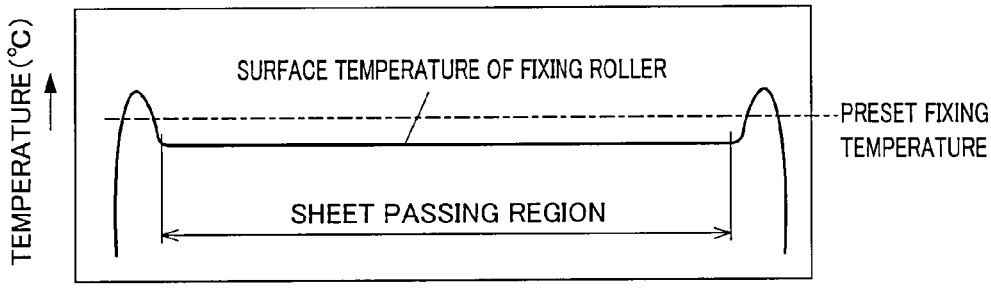
Figure 8:
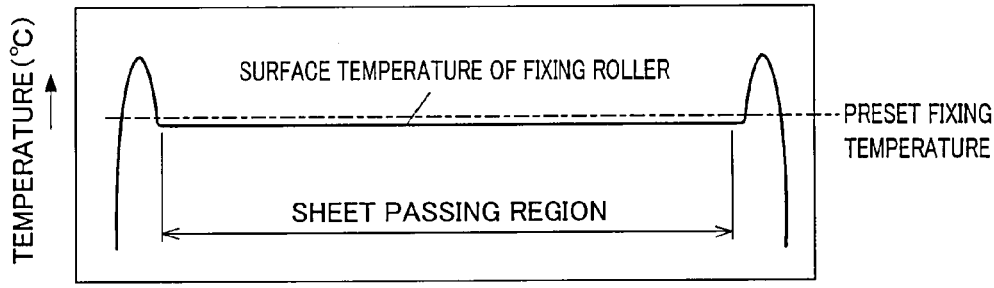
Figure 8:
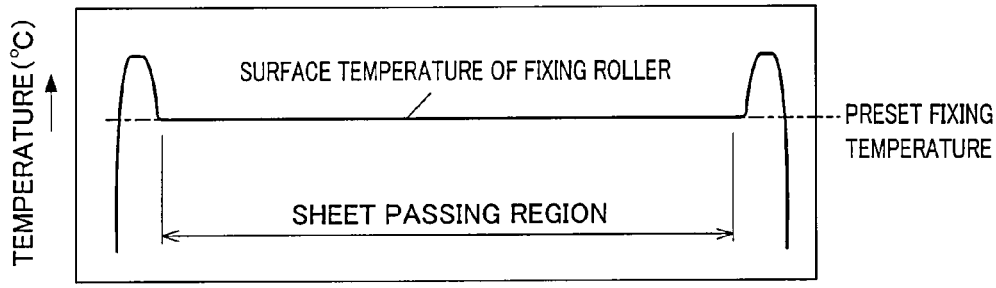
Figure 9:
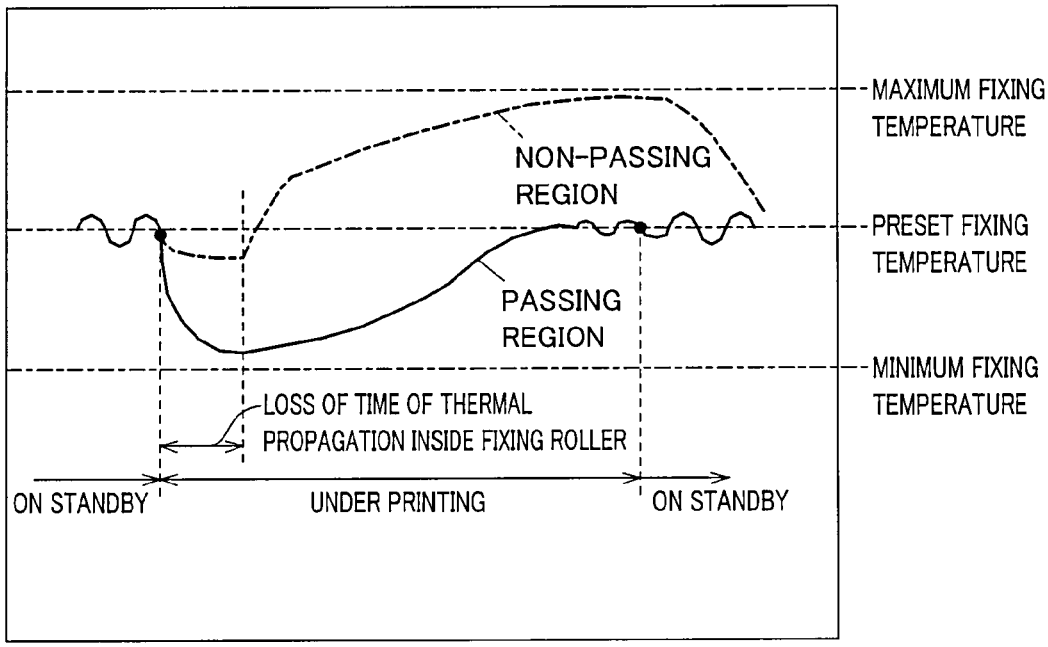
FIG. 9 is a view illustrating progressions of surface temperatures of the fixing roller in (i) a region of the fixing roller where a paper sheet passes and (ii) a region of the fixing roller where a paper sheet does not pass, in continuous printing process in a typical image forming apparatus.
Figure 10:
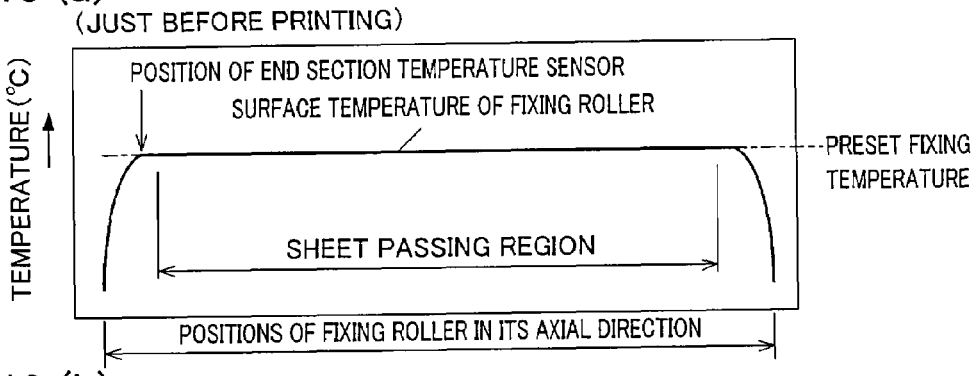
FIGS. 10(*a*) through 10(*d*) are views illustrating relationships between positions of the fixing roller in its axial direction and surface temperatures of the fixing roller in the conventional image forming apparatus, just before the start of continuous printing, right after the start of the continuous printing using large-size paper sheets, in the middle of the continuous printing, and at the end of the continuous printing, respectively.
Figure 10:
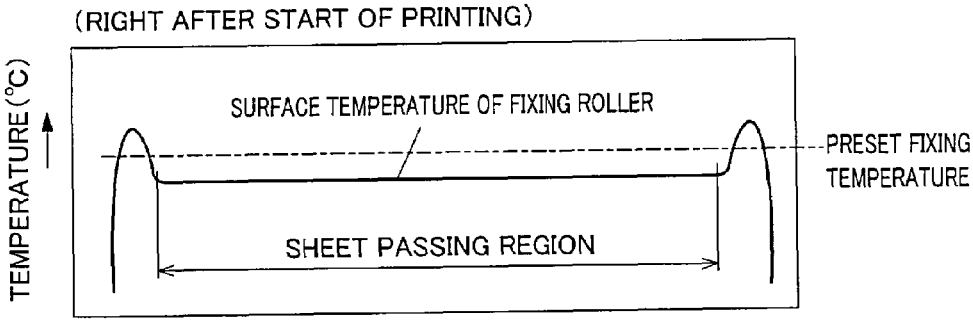
Figure 10:
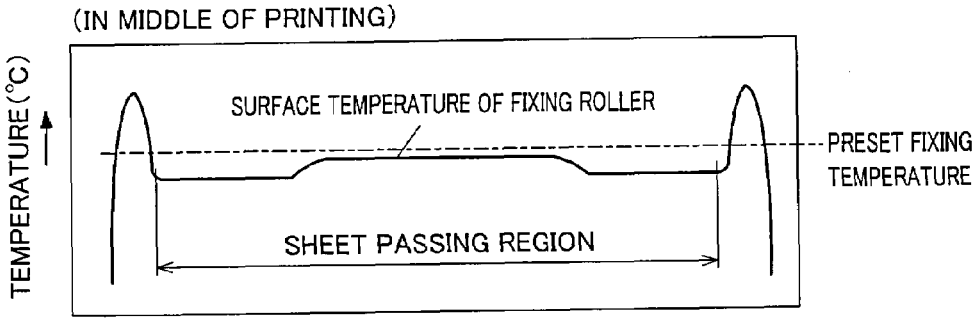
Figure 10:
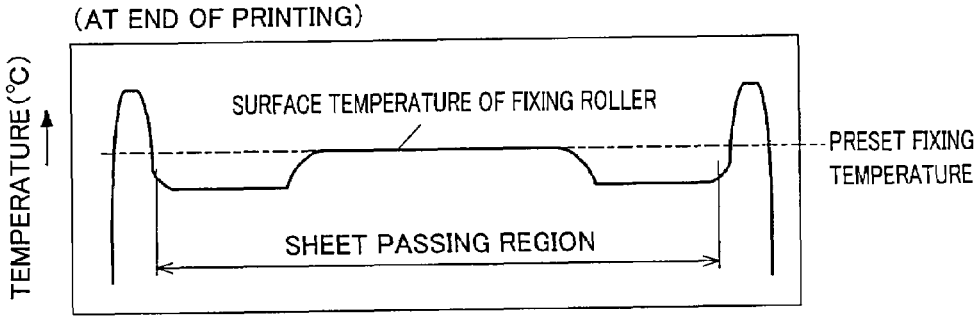
Figure 11:
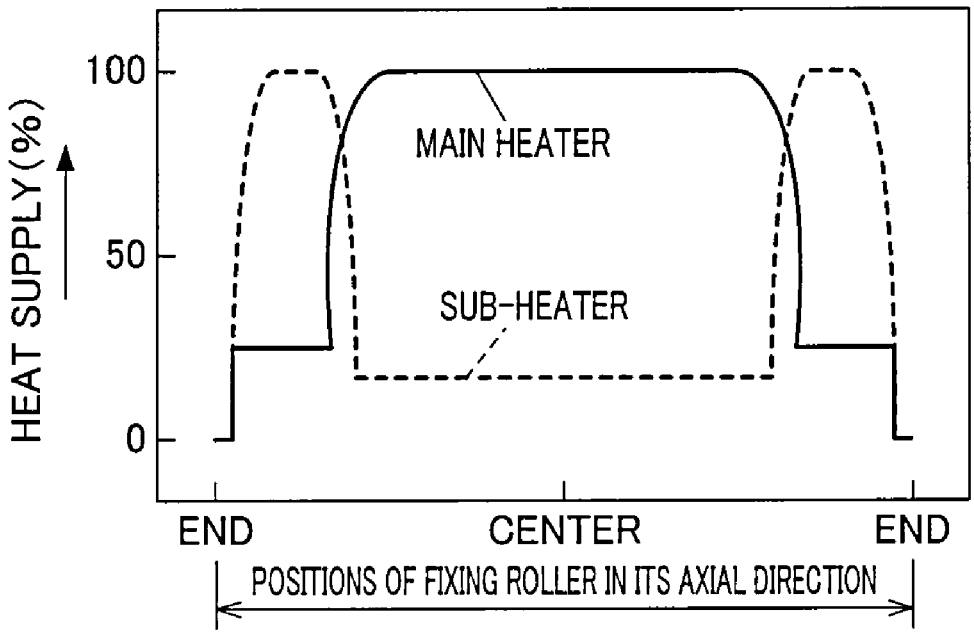
FIG. 11 is a view illustrating a relationship between a position of the fixing roller in its axial direction and a heat supply rate in a main heater and a sub-heater, respectively.

FIGS. 8(*a*) through 8(*d*) illustrate relationships between positions of the fixing roller in its axial direction and surface temperatures of the fixing roller in the present image forming apparatus 1, just before the start of continuous printing, right after the start of continuous printing using large-size paper sheets, in the middle of continuous printing, and at the end of continuous printing, respectively.

As illustrated in FIGS. 8(*c*) and 8(*d*), the sub-heater 16 is appropriately on/off controlled until continuous printing is completed. Thus, a surface of the fixing roller 12 is maintained at the preset fixing temperature over the entire maximum-size sheet passing region at the end of printing.

When continuous printing process is restarted after having been interrupted, for example, in the event of recording material jam and in the event of process control for equalization of print quality (stabilization of output image), the end section temperature control section 28 returns the end section fixing control temperature to the initial value of Level 1.

The reason for this is as follows. When the process is interrupted even in the continuous printing process, power supplies to the main heater 15 and the sub-heater 16 are temporarily stopped. This decreases a surface temperature in a region where the end section temperature sensor 20 is disposed. When the continuous printing process is restarted while the end section fixing control temperature remains high, the sub-heater 16 is not turned on. This causes temperature variations on the surface of the fixing roller 12.

In view of this, as illustrated in FIG. 1, the image forming apparatus 1 of the present embodiment is arranged such that an interruption signal for instructing interruption of continuous printing process is supplied to the printed sheet counting section 40 and the end section fixing control temperature changing section 41. When receiving the interruption signal, the printed sheet counting section 40 resets the count to zero. When receiving the interruption signal, the end section fixing control temperature changing section 41 returns the end section fixing control temperature to the initial value of Level 1.

As described above, energization of the sub-heater 16 is controlled in accordance with a temperature detected by the end section temperature sensor 20, which is disposed outside the maximum-size sheet passing region of the fixing roller 12. In this arrangement, failure of power supply to the sub-heater 16 can occur in the continuous printing using large-size paper sheets that requires energization of the sub-heater 16. However, according to the present image forming apparatus 1, in the continuous printing process, the end section temperature control section 28 changes the end section fixing control temperature to perform on/off control of the sub-heater 16 in accordance with a temperature detected by the end section temperature sensor 20, which is disposed outside the region where a maximum-size recording material that can be used for the fixing member passes. More specifically, the present image forming apparatus 1 is arranged such that the larger the number of paper sheets that have been processed in one continuous printing process, the higher the control temperature.

Thus, even when there is rise in temperature detected by the end section temperature sensor 20, the end section fixing control temperature itself is changed. This avoids the failure of power supply to the sub-heater 16, and avoids fixing failure caused by variations of surface temperature of the fixing roller 12 in the continuous printing process using large-size recording materials.

As described above, a fixing apparatus of the present invention is a fixing apparatus which causes a recording material to pass between a rotatable fixing member and a pressure member that press-contacts the fixing member so as to fix a toner image formed on the recording material, the fixing apparatus comprising: a plurality of heat sources, which are disposed inside the fixing member, having mutually different regions as heating regions; a plurality of temperature detecting members, disposed on a surface side of the fixing member so as to correspond to the heat sources, which detect surface temperatures of the fixing member; and a fixing control section which controls power supplies to the heat sources so that surfaces of the fixing member are maintained at a preset fixing temperature, in accordance with temperatures detected by the temperature detecting members, wherein: out of the temperature detecting members, an end section temperature detecting member which is disposed at an end section of the fixing member is disposed outside a region of the fixing member where a maximum-size recording material that can be used by an image forming apparatus in which the fixing apparatus is installed passes; and in continuous printing process, the fixing control section changes a control temperature for controlling power supply to the heat source which is disposed corresponding to the end section of the fixing member, in accordance with a temperature detected by the end section temperature detecting member.

As described above, an image forming apparatus of the present invention is an image forming apparatus comprising a fixing apparatus which causes a recording material to pass between a rotatable fixing member and a pressure member that press-contacts the fixing member so as to fix a toner image formed on the recording material, the fixing apparatus comprising: a plurality of heat sources, which are disposed inside the fixing member, having mutually different regions as heating regions; a plurality of temperature detecting members, disposed on a surface side of the fixing member so as to correspond to the heat sources, which detect surface temperatures of the fixing member; and a fixing control section which controls power supplies to the heat sources so that surfaces of the fixing member are maintained at a preset fixing temperature, in accordance with temperatures detected by the temperature detecting members, wherein: out of the temperature detecting members, an end section temperature detecting member which is disposed at an end section of the fixing member is disposed outside a region of the fixing member where a maximum-size recording material that can be used by the image forming apparatus passes; and in continuous printing process, the fixing control section changes a control temperature for controlling power supply to the heat source which is disposed corresponding to the end section of the fixing member, in accordance with a temperature detected by the end section temperature detecting member.

In continuous printing with respect to paper sheets having a size that requires power supply to the heat source disposed corresponding to the end section of the fixing member (hereinafter referred to as end section heat source), failure of power supply to the end section heat source can occur because a surface temperature of the fixing member decreases in a recording material passing region at the end section of the fixing member, but a temperature detected by the end section temperature detecting member which is disposed in a region of the fixing member where the recording material does not pass.

However, according to the above arrangement, in continuous printing process, the fixing control section changes a control temperature for controlling power supply to the end section heat source which is disposed corresponding to the end section of the fixing member, in accordance with a temperature detected by the end section temperature detecting member which is disposed outside a region of the fixing member where a maximum-size recording material that can be used by the image forming apparatus passes. More specifically, the larger the number of paper sheets that have been processed in one continuous printing process, the higher the control temperature.

Thus, even when there is rise in temperature detected by the end section temperature detecting member, which is disposed in a region of the fixing member where the recording material does not pass, the control temperature itself is changed. This avoids the failure of power supply to the end section heat source.

It is possible to change the control temperature, for example, in an arrangement in which the fixing control section changes the control temperature in accordance with the number of paper sheets that have been processed in one continuous printing process, or an arrangement in which the fixing control section changes the control temperature in accordance with the number of paper sheets that continuously have passed through the fixing member in one continuous printing process.

It is preferable that the fixing control section returns the control temperature to an initial value if the continuous printing process is restarted after having been interrupted. The interruption of the continuous printing process is considered to occur in the event of recording material jam or in the event of process control for equalization of print quality.

When the process is interrupted even in the continuous printing process, power supplies to the heat sources are temporarily stopped. This decreases a surface temperature in a region of the fixing member where the recording material does not pass. When the continuous printing process is restarted while the control temperature remains high, power is not supplied to the end section heat source. This causes temperature variations on the surface of the fixing member.

The fixing control section implementing such an arrangement can be realized by including: for example, a counting section which counts the number of paper sheets that have been processed in a continuous printing process; a control temperature changing section which has a table that includes control temperatures determined respectively corresponding to the numbers of processed paper sheets, and selects a control temperature in accordance with a result of counting carried out by the counting section; and a determining section which determines whether power to the heat source which is disposed at the end section of the fixing member is to be supplied or not, in accordance with a temperature detected by the end section temperature detecting member and a control temperature selected by the control temperature changing section.

According to this arrangement, the counting section counts the number of paper sheets that have been processed in a continuous printing process, the control temperature changing section selects a control temperature in accordance with a result of counting carried out by the counting section, with reference to a table a table that includes control temperatures determined respectively corresponding to the numbers of processed paper sheets, and the determining section determines whether power to the end section heat source is to be supplied or not, in accordance with a selected control temperature and a temperature detected by the end section temperature detecting member.

In this arrangement, it is preferable that an interruption signal for instructing interruption of the continuous printing process is supplied to the counting section and the control temperature changing section; the counting section resets a count to zero upon receipt of the interruption signal; and the control temperature changing section returns the control temperature to an initial value upon receipt of the interruption signal.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A fixing apparatus which causes a recording material to pass through a space between a rotatable fixing member and a pressure member that press-contacts the fixing member so as to fix a toner image formed on the recording material, the fixing apparatus comprising:

a plurality of heat sources, which are disposed inside the fixing member, having mutually different regions as heating regions;

a plurality of temperature detecting members, disposed on a surface side of the fixing member so as to correspond to the heat sources, which detect surface temperatures of the fixing member; and a fixing control section which controls power supplies to the heat sources so that surfaces of the fixing member are maintained at a preset fixing temperature, in accordance with temperatures detected by the temperature detecting members, wherein:

out of the temperature detecting members, an end section temperature detecting member which is disposed at an end section of the fixing member is disposed outside a region of the fixing member where a maximum-size recording material that can be used by an image forming apparatus in which the fixing apparatus is installed passes;

in continuous printing process, the fixing control section changes a control temperature for controlling power supply to the heat source which is disposed corresponding to the end section of the fixing member, in accordance with a temperature detected by the end section temperature detecting member; and the larger the number of paper sheets that have been processed in one continuous printing process or the number of paper sheets that continuously have passed through the fixing member in one continuous printing process, the higher the fixing control section sets the control temperature.

2. The fixing apparatus according to claim 1, wherein:

the fixing control section changes the control temperature in accordance with the number of paper sheets that have been processed in one continuous printing process.

3. The fixing apparatus according to claim 1, wherein:

the fixing control section changes the control temperature in accordance with the number of paper sheets that continuously have passed through the fixing member in one continuous printing process.

4. The fixing apparatus according to claim 1, wherein:

the fixing control section returns the control temperature to an initial value when the continuous printing process is restarted after having been interrupted.

5. The fixing apparatus according to claim 4, wherein:

the interruption of the continuous printing process occurs in the event of recording material jam or in the event of process control for equalization of print quality.

6. The fixing apparatus according to claim 1, wherein:

the fixing control section comprises:

a counting section which counts the number of paper sheets that have been processed in one continuous printing process;

a control temperature changing section which has a table that includes control temperatures determined respectively corresponding to the numbers of processed paper sheets, and selects a control temperature in accordance with a result of counting carried out by the counting section; and a determining section which determines whether power to the heat source which is disposed at the end section of the fixing member is to be supplied or not, in accordance with a temperature detected by the end section temperature detecting member and a control temperature selected by the control temperature changing section.

7. The fixing apparatus according to claim 6, wherein:

an interruption signal for instructing interruption of the continuous printing process is supplied to the counting section and the control temperature changing section;

the counting section resets a count to zero upon receipt of the interruption signal; and the control temperature changing section returns the control temperature to an initial value upon receipt of the interruption signal.

8. An image forming apparatus comprising a fixing apparatus which causes a recording material to pass between a rotatable fixing member and a pressure member that press-contacts the fixing member so as to fix a toner image formed on the recording material, the fixing apparatus comprising:

a plurality of heat sources, which are disposed inside the fixing member, having mutually different regions as heating regions;

a plurality of temperature detecting members, disposed on a surface side of the fixing member so as to correspond to the heat sources, which detect surface temperatures of the fixing member; and a fixing control section which controls power supplies to the heat sources so that surfaces of the fixing member are maintained at a preset fixing temperature, in accordance with temperatures detected by the temperature detecting members, wherein:

out of the temperature detecting members, an end section temperature detecting member which is disposed at an end section of the fixing member is disposed outside a region of the fixing member where a maximum-size recording material that can be used by the image forming apparatus passes;

in continuous printing process, the fixing control section changes a control temperature for controlling power supply to the heat source which is disposed corresponding to the end section of the fixing member, in accordance with a temperature detected by the end section temperature detecting member; and the larger the number of paper sheets that have been processed in one continuous printing process or the number of paper sheets that continuously have passed through the fixing member in one continuous printing process, the higher the fixing control section sets the control temperature.

9. The image forming apparatus according to claim 8, wherein:

the fixing control section comprises:

a counting section which counts the number of paper sheets that have been processed in one continuous printing process;

a control temperature changing section which has a table that includes control temperatures determined respectively corresponding to the numbers of processed paper sheets, and selects a control temperature in accordance with a result of counting carried out by the counting section; and a determining section which determines whether power to the heat source which is disposed at the end section of the fixing member is to be supplied or not, in accordance with a temperature detected by the end section temperature detecting member and a control temperature selected by the control temperature changing section.

* * * * *